US006243910B1

(12) United States Patent
Diehl

(10) Patent No.: US 6,243,910 B1
(45) Date of Patent: Jun. 12, 2001

(54) APPARATUS FOR CLEANING THE TUBULAR FRAMES OF SCAFFOLDING

(76) Inventor: Gunter Diehl, Haubergstr. 17, D-57548 Kirchen-Katzenbach (DE)

( * ) Notice: Subject to any disclaimer, the term of this patent is extended or adjusted under 35 U.S.C. 154(b) by 0 days.

(21) Appl. No.: 09/244,023

(22) Filed: Feb. 4, 1999

(30) Foreign Application Priority Data

Feb. 4, 1998 (DE) ..... 198 04 228

(51) Int. Cl.[7] ..... A47L 13/08

(52) U.S. Cl. ..... 15/236.06; 15/236.07; 15/93.1; 30/172

(58) Field of Search ..... 15/236.05, 236.06, 15/236.07, 104.03, 104.04, 93.1; 30/169, 172

(56) References Cited

U.S. PATENT DOCUMENTS

| | | | | |
|---|---|---|---|---|
| 84,587 | * | 12/1868 | Sloat | 15/104.04 |
| 363,561 | * | 5/1887 | Stoddard | 15/236.05 |
| 440,028 | * | 11/1890 | Glover et al. | 15/104.04 |
| 647,676 | * | 4/1900 | Laverack | 15/104.04 |
| 674,038 | * | 5/1901 | Obey | 15/236.05 |
| 791,228 | * | 5/1905 | Rohrer | 15/236.07 |
| 860,030 | * | 7/1907 | Jenkins | 15/104.04 |
| 1,056,050 | * | 3/1913 | Nyberg | 15/104.04 |
| 1,145,966 | * | 7/1915 | Bergmann | 15/236.07 |
| 1,355,574 | * | 10/1920 | Ryberg | 15/104.04 |
| 1,995,513 | * | 3/1935 | Marckres | 15/236.06 |
| 2,236,093 | * | 3/1941 | Friend | 15/236.06 |
| 2,275,713 | * | 3/1942 | Ahlborg | 30/172 |
| 2,696,627 | * | 12/1954 | Lewis | 15/104.04 |
| 2,824,323 | * | 2/1958 | Tos et al. | 15/104.04 |
| 2,951,286 | * | 9/1960 | Mann | 15/93.1 |
| 2,983,943 | * | 5/1961 | Fendler | 15/236.06 |
| 3,486,183 | * | 12/1969 | Caprioli | 15/236.07 |
| 3,719,993 | * | 3/1973 | Caprioli | 15/104.04 |
| 3,811,160 | * | 5/1974 | MacDonald | 15/93.1 |
| 4,112,537 | * | 9/1978 | Heuck | 15/236.05 |
| 4,182,000 | * | 1/1980 | Fairbairn | 15/93.1 |
| 4,305,175 | * | 12/1981 | Burgess, Jr. | 15/236.06 |
| 4,649,849 | * | 3/1987 | McCormick | 15/104.04 |
| 4,663,794 | * | 5/1987 | Evans | 15/104.04 |
| 4,958,403 | * | 9/1990 | Martin | 15/236.07 |
| 5,600,862 | * | 2/1997 | Bleske et al. | 15/104.04 |

FOREIGN PATENT DOCUMENTS

| | | | | |
|---|---|---|---|---|
| 699624 | * | 11/1940 | (DE) | 15/104.04 |
| 8380 | * | 3/1912 | (GB) | 15/104.04 |

* cited by examiner

*Primary Examiner*—Gary K. Graham
(74) *Attorney, Agent, or Firm*—Young & Thompson

(57) ABSTRACT

To be able to easily and quickly remove adhering dirt, for example rendering mortar, from the pipes of the tubular frame of scaffolding both with the scaffold assembled and disassembled, a device is proposed which has scraper elements (2–5) which are attached to a frame (1) and which when used with a corresponding recess (6) encompasses a scaffold pipe to be cleaned over roughly half its periphery.

8 Claims, 2 Drawing Sheets

APPARATUS FOR CLEANING THE TUBULAR FRAMES OF SCAFFOLDING

BACKGROUND OF THE INVENTION

1. Field of the Invention

The invention relates to a device for cleaning the tubular frames of scaffolding.

2. Description of the Related Art

In building renovation, for example exterior rendering, it is impossible to avoid fouling the tubular frames of scaffolding with rendering mortar, especially sprayed rendering. The mortar then adheres to the scaf folding pipe and at a given time must be removed. This is however a tedious and time-consuming activity. The adhering dried mortar droppings are generally knocked off with a hammer and/or scraped off with a trowel; this often leads to damage of the galvanized surface of the scaffolding pipes.

SUMMARY OF THE INVENITION

The object of the invention is to devise a device with which adhering mortar droppings and other dirt can be carefully and easily removed from scaffolding pipes both with the scaffolding erected and also in the disassembled state.

BRIEF DESCRIPTION OF THE DRAWINGS

The invention is described here using the drawings which show it by way of example.

DESCRIPTION OF THE PREFERRED EMBODIMENTS

Figures 1, 2:
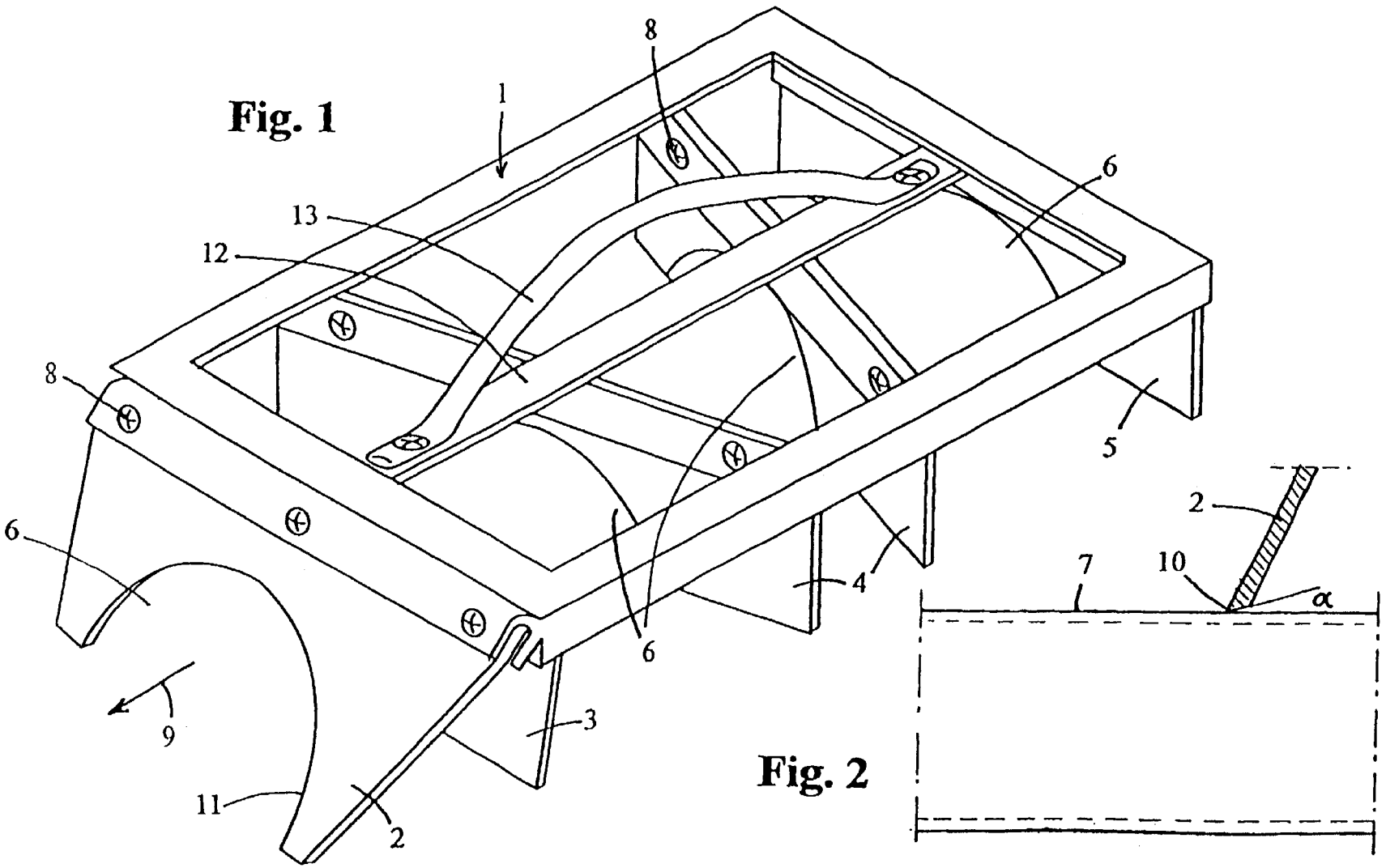
FIG. 1 shows a perspective view of the device.
FIG. 2 shows a section through the frontmost scraper element.

The device for cleaning the tubular frames of scaffolding which is shown in FIG. 1 has a frame 1 on which several scraper elements 2, 3, 4 and 5 are detachably and thus interchangeably fastened. The scraper elements 2, 3, 4, 5 project downward and are provided with recesses 6 which, when the device is being used, fit over a scaffold pipe 7 (See FIG. 2) over roughly half of its periphery. The scraper elements 2, 3, 4, 5 are attached with screws 8 and can therefore be replaced when necessary.

As FIG. 1 shows, the scraper element 2 which is the frontmost in the scraping direction 9, viewed from the side, is attached obliquely to the frame 1 and has a cutting edge 10 which is ground on an angle (see FIG. 2) and which forms a small acute angle $\alpha$ with the top edge of the scaffold pipe 7 to be cleaned.

The scraper element 3 which is located in the scraping direction 9 behind the frontmost scraper element 2 is not positioned entirely as obliquely as the frontmost scraper element 2 and is used like the following scraper elements 4 and 5 for reworking of the scaffold pipes 7. The scraper elements 4 project perpendicularly from the frame 1 downward, the inner scraper elements 4 however viewed from overhead being located obliquely to the axis of the scaffold pipe 7 to be cleaned. The recesses 6 of all scraper elements 2, 3, 4, besides those of the scraper element 5 which is the last in the scraping direction 9 are made elliptical due to their oblique position to the axis of the scaffold pipe 7 to be cleaned according to the respective cylinder section in order to fit around the scaffold pipe 7 over roughly half its periphery. The scraper element 5 which is attached to the end of the frame 1 which is the back end in the scraping direction 9 is located both perpendicularly to the frame 1 and also perpendicularly to the axis of the scaffold pipe 7 to be cleaned.

As FIG. 1 indicates, the recess 6 of the frontmost scraper element 2 on one side facing the viewer of FIG. 1 has a longer arc 11 than on the other side of the scaffold pipe 7 to be cleaned.

A handhold 13 can be detachably mounted on a center lengthwise strut 12 of the frame 1 and it can also be shaped differently than shown.

Figure 3:
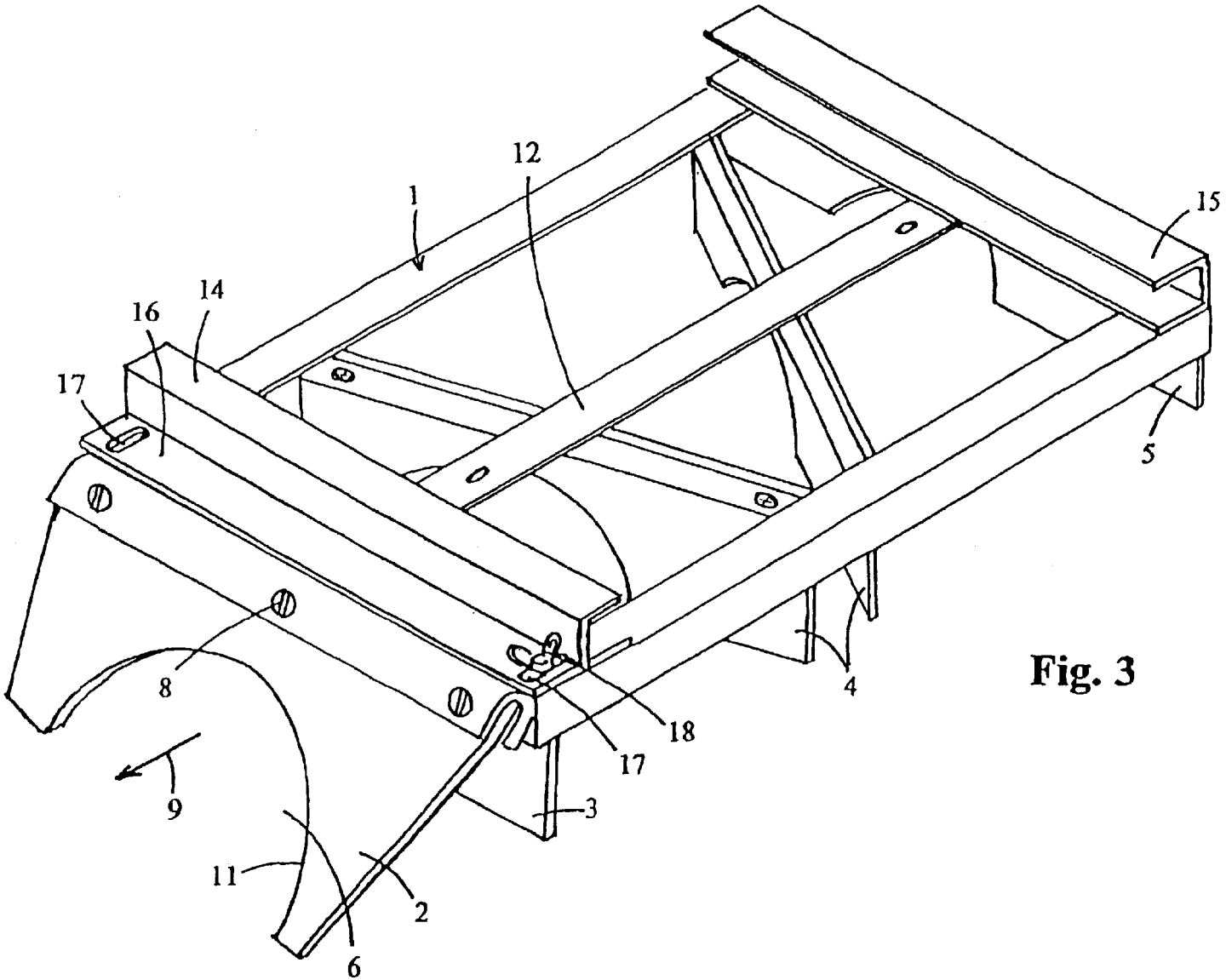
FIG. 3 shows one modification of the device in a perspective view.

In the embodiment shown in FIG. 3, on the top of the frame 1 there are U-sections 14 and 15 for clamping a commercial vibrating grinder (not shown), and the U-section 14 with an angular projection 16 can be adjusted via elongated holes 17 and wing nuts 18 (only one is shown). Using the vibrating grinder (without the abrasive blade) stubborn dirt can be removed more easily from the scaffold pipe 7, as a result of the vibrations which the vibration grinder delivers. Of course the handhold 13 is removed to attach the vibrating grinder.

What is claimed is:

1. Device for cleaning of the tubular frames of scaffolding, comprising:

a frame;

scraper elements attached to the frames each of said scraper elements comprising a recess adapted to fit over a pipe of the tubular frames of the scaffolding over roughly half of a periphery of the pipe; and U-sections provided on a surface of the frame for clamping a commercial vibrating grinder.

2. Device as claimed in claim 1, wherein a frontmost one of the scraper elements, as viewed from the side, is attached obliquely to the frame, the frontmost scraper element having a cutting edge which is ground so that in use the cutting edge forms an acute angle (a) with a surface of the scaffold pipe to be cleaned.

3. Device as claimed in claim 2, wherein each of a plurality of the scraper elements other than the frontmost scraper element is positioned perpendicular to the frame and oblique to an axis of the scaffold pipe to be cleaned.

4. Device as claimed in claim 2, wherein an endmost one of the scraper elements opposite the frontmost scraper element is positioned perpendicular to both the frame and an axis of the scaffold pipe to be cleaned.

5. Device as claimed in claim 2, wherein the recess of the frontmost scraper element has a longer arc on one side of an axis of the scaffold pipe than on another side thereof.

6. Device as claimed in claim 1, further comprising a handhold (13) which is attached to a lengthwise strut of the frame away from the scraper elements.

7. Device as claimed in claim 6, wherein the handhold is detachably mounted to the lengthwise strut (12).

8. Device as claimed in claim 1, wherein the scraper elements are removably attached to the frame.

* * * * *